United States Patent [19]

Minegishi et al.

[11] 4,401,065

[45] Aug. 30, 1983

[54] GLOW PLUGS FOR USE IN DIESEL ENGINES

[75] Inventors: Sokichi Minegishi; Tozo Takizawa, both of Higashi-matsuyama; Hideo Kawamura, Samukawa; Nobukazu Sagawa, Kyoto, all of Japan

[73] Assignees: Jidosha Kiki Co., Ltd.; Isuzu Motors Ltd.; Kyoto Ceramic Co., Ltd., all of Japan

[21] Appl. No.: 292,306

[22] Filed: Aug. 12, 1981

[30] Foreign Application Priority Data

| | | | |
|---|---|---|---|
| Aug. 23, 1980 | [JP] | Japan | 55-116317 |
| Aug. 23, 1980 | [JP] | Japan | 55-119820[U] |
| Aug. 23, 1980 | [JP] | Japan | 55-119821[U] |

[51] Int. Cl.[3] ..... F02P 19/00; F02P 19/02; H05B 3/00

[52] U.S. Cl. ..... 123/145 A; 361/264; 219/267

[58] Field of Search ..... 123/145 A, 145 R; 361/264, 266; 219/267, 270

[56] References Cited

U.S. PATENT DOCUMENTS

| | | | |
|---|---|---|---|
| 1,950,457 | 3/1934 | Payne et al. | 123/145 A |
| 2,096,198 | 10/1937 | Rabozzana | 123/145 A |
| 4,107,510 | 8/1978 | Tombs et al. | 123/145 A |
| 4,112,577 | 9/1978 | Mann | 123/145 A |
| 4,237,843 | 12/1980 | Page et al. | 123/145 A |
| 4,357,526 | 11/1982 | Yamamoto et al. | 123/145 A |

FOREIGN PATENT DOCUMENTS

| | | | |
|---|---|---|---|
| 489225 | 9/1918 | France | 123/145 A |

*Primary Examiner*—Raymond A. Nelli
*Attorney, Agent, or Firm*—Remy J. VanOphem

[57] ABSTRACT

In a glow plug, a pair of ceramic rods having longitudinal bonding surfaces are used as a heating rod. A resistor including a heater, and a pair of lead portions connected to both ends of the heater and extending to rear ends of the ceramic rods is continuously disposed on one bonding surface of the ceramic rods. One of the lead portions extends through a hollow metal holder, while the other lead portion is connected to an external connecting terminal mounted through an insulating member.

18 Claims, 5 Drawing Figures

GLOW PLUGS FOR USE IN DIESEL ENGINES

BACKGROUND OF THE INVENTION

This invention relates to a glow plug adapted to preheat the interior of a cylinder of a diesel engine.

Since the starting characteristic of a diesel engine at low temperatures is generally poor it is usual to install a glow plug in the cylinder so as to increase the temperature in the cylinder by passing electric current through the glow plug, thereby improving the starting characteristic of the engine.

As the glow tube, it has been used as a sheath heater in which a helical heating wire is embedded in a powder of heat resistant electric insulation packed in a tubular sheath made of heat resistant metal. Since heating with the sheath heater is an indirect heating, it takes a long time to raise the temperature in the cylinder. Thus, the heat generated by passing current through the heating wire is transmitted to the sheath through the heat insulating powder and then radiated into the cylinder, so that the efficiency of heat transmission is low. For example, it takes about ten seconds to increase the temperature in the cylinder to 800° C. If the current is increased to shorten the preheating time, the heating wire would melt or the sheath would be broken due to high temperature. In the manufacture of a sheath heater it is necessary to take care not to cause short circuiting between the heating wire and the sheath at the time of packing the insulating powder. For this reason it is necessary to precoat the heating wire with an electric insulator or to form an electric insulating layer on the inner surface of the sheath.

In Japanese Preliminary Publication of patent specification No. 109536/1979 dated Aug. 28, 1979, a ceramic heater utilized as a glow plug is disclosed in which a multilayer substrate technique is used for improving the efficiency of heat transmission. According to this technique a plurality of thin disc shaped ceramic green sheets, each printed with a resistor, are laminated into an integral rod. With this construction, however, it is necessary to prepare a number of green sheets, each printed with a resistor, on a narrow surface and to connect in series or parallel both ends of respective resistors exposed on the periphery of the stacked sheets for electrically interconnecting resistors on respective sheets. This often fails to connect the resistors in a desired pattern.

SUMMARY OF THE INVENTION

Accordingly, it is an object of this invention to provide an improved glow plug for use in a diesel engine.

Another object of this invention is to provide a glow plug for use in a diesel engine which is simpler in construction and easier to manufacture and assemble than prior art glow plugs utilizing stacked ceramic discs.

Still another object of this invention is to provide an improved glow plug for use in a diesel engine having reliable temperature characteristics which can be manufactured at a low cost.

According to this invention, to accomplish these objectives, a pair of ceramic rods having bonding surfaces extending in the longitudinal direction are prepared, a resistor acting as an electric heater is formed on one of the bonding surfaces and the opposite ends of the resistor are connected to the outer periphery of the ceramic rods through lead patterns. One of the lead patterns is connected to a hollow metal holder and the other lead pattern is connected to an external connecting terminal secured through an electrical insulating member.

According to this invention, a glow plug is provided plug for use in a diesel engine, characterized by a heating rod which is formed by bonding together a pair of ceramic rods having a resistor formed in a longitudinal direction of one bonding surface, a hollow electroconductive holder holding the heating rod at a front end, and an external connecting terminal connected to a rear end of the holder through an electrical insulating member, the resistor having a serially connected heating portion provided on a front portion of the ceramic rod, a lead portion extending from one end of the heating portion, a portion of the lead portions being exposed on the outer side of the heating rod and connected to the external connecting terminal, and another lead portion extending from the other end of the heating portion toward the rear side, a portion of another lead portion being exposed to the outside of the heating rod and connected to the holder.

In an alternate embodiment, a flexible lead wire leading to an external terminal is embedded in a packed powder of heat resistant electric insulating material.

DESCRIPTION OF THE PREFERRED EMBODIMENTS

Figures 1, 2:
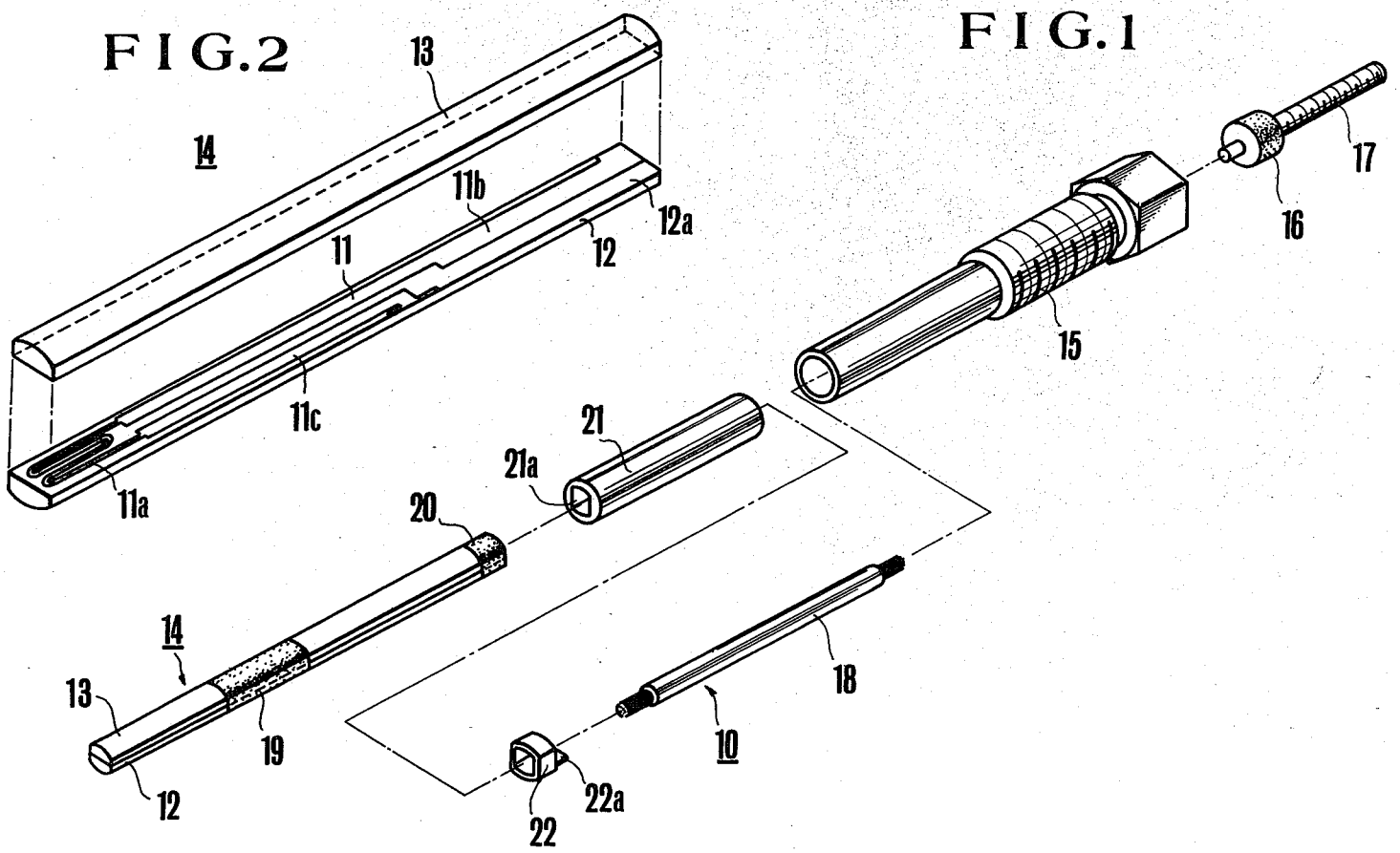
FIG. 1 is an exploded perspective view showing component elements of a glow plug for use in a diesel engine according to the present invention.
FIG. 2 is a perspective view illustrating the resistors of the glow plug shown in FIG. 1 mounted on ceramic rods.
Figure 3:
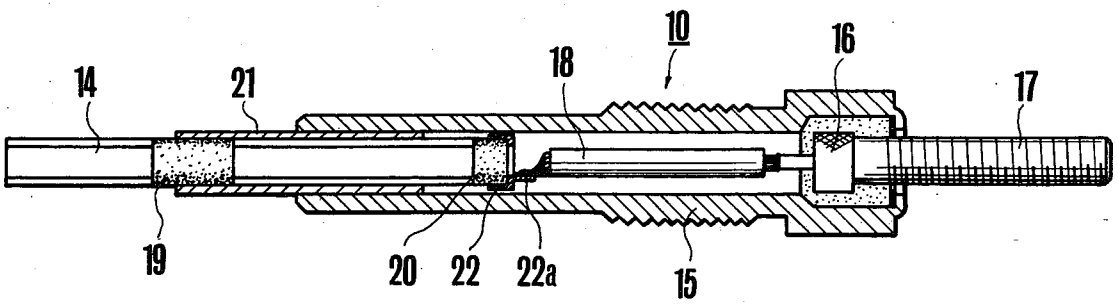
FIG. 3 is a longitudinal sectional view of a glow plug obtained by assembling the component elements shown in FIG. 1.

A glow plug generally designated by the reference numeral 10, and shown in FIGS. 1 through 3, includes a heating rod 14 formed by bonding together a pair of ceramic rods 12 and 13 having a resistor 11 at one bonding surface, and a substantially tubular holder 15 which holds the heating rod 14 at one end thereof. An external connecting terminal 17 is fitted into the holder 15 through a longitudinal space chamber therein and an insulating bushing 16 made of a synthetic resin, for example, and the terminal 17 are connected to the rear end of the heating rod 14 through a multistrand metal conductor 18.

The heating rod 14 has a substantially elliptical cross-sectional configuration and is formed by sintering under pressure the pair of ceramic rods 12 and 13. The elliptical cross-sectional configuration of the heating rod 14 improves the density of the ceramic material and thereby improves the mechanical strength, electric insulating strength and the efficiency of heat conduction. Silicon non-oxide materials having excellent electrical insulating properties and heat conductivity, for example, nitride materials such as silicon nitride $Si_3N_4$ are preferred as the materials for preparing the pair of ceramic rods 12 and 13. $Si_3N_4$ has a higher temperature strength than metals, alumina, or the like. It also has a high heat impact strength and excellent electrical insulating wear resistant and chemical resistant properties thus fulfilling substantially all characteristics required by the glow plug.

The resistor 11 contained in the heating rod 14 is formed on a bonding surface 12*a* of one ceramic rod 12 in a manner as shown in FIG. 2. More particularly, the resistor 11 is constituted by a wavy or shaky heating portion 11*a* at one end of the ceramic rod 12 to extend in a direction perpendicular to the longitudinal direction thereof, a first lead conductor 11*b* extending from one end of the heating portion 11*a* through the ceramic rod 12 to the rear side thereof, the rear end of the lead conductor 11*b* on the outside of the ceramic rod 12 being exposed, and a second lead conductor 11*c* extending, in spaced parallel relation with the first lead conductor 11*b*, from the other end of the heating portion 11*a* toward the rear end thereof and brought to the outside from one side of the central portion of the ceramic rod 12, the heating portion 11*a*, the first and second lead conductors 11*b* and 11*c* being formed on the bonding surface 12*a*. It is to be noted that the resistor 11, and the lead conductors 11*b* and 11*c* have substantially the same thickness, that the width of the heating portion 11*a* of the resistor 11 is made sufficiently narrow so as to make its resistance to be sufficiently high, and that the widths of the lead conductors 11*b* and 11*c* are made larger than the width of the heating portion 11*a* so as to decrease the resistances of the lead conductors 11*b* and 11*c*. In other words, the resistor 11 is integrally formed on the bonding surface 12*a* of the ceramic rod 12 and the heating portion 11*a* and pair of lead conductors 11*b* and 11*c* are defined by suitably selecting the width and length of the resistor 11. This construction permits ready preparation of the resistor 11 by printing it on the bonding surface 12*a* of the ceramic rod as a thin electroconductive film, by bonding, firing or vapor depositing a filament or a plate shaped high melting point metal. Furthermore, it is possible to use only a predetermined portion 11*a* as a heating portion which enables rapid heating of only a predetermined portion of the rod 12. By varying the pattern of the completed resistor 11 as described above the resistance value thereof can be readily controlled which enables rapid red heating of the tip of the heating rod which is desirable to improve the starting characteristic of a specific engine.

The heating portion 11*a* and lead conductors 11*b* and 11*c* are completely embedded in the heater rod 14 when the ceramic rods 12 and 13 are bonded together and only the end portions of the lead conductors 11*b* and 11*c* are exposed. Preferably, the end portions of the lead conductors 11*b* and 11*c* are exposed by sintering them while being embedded in the heating portion 11*a* and thereafter by grinding off the portion of the heating portion 11*a* covering the end portions. This method eliminates the possibility of forming cracks in the ceramic.

The material for preparing the resistor 11 may be a metal such as tungsten because the sintering temperature of the ceramic is high, for example higher than 1500° C., so that the resistor should be heat resistant.

As shown in FIGS. 1 and 3, metal coating layers 19 and 20 formed by metal such as nickel are applied to the peripheries of the central portion and the rear end of the heating rod 14. The purpose of these metal coating layers 19 and 20 is to electrically connect the opposite ends of the resistor 11 embedded in the heating rod 14, that is the ends of respective lead conductors 11*b* and 11*c* to an external circuit so that these metal coating layers are formed in contact with the exposed ends of the lead conductors 11*b* and 11*c*, because it is difficult to directly weld or solder metal members to the heating rod 14 made of ceramic.

A reinforcing metal pipe 21 having an inner diameter substantially equal to the outer diameter of the heating rod 14 is fitted over the central portion thereof, and a terminal cap 22 is applied to the rear end of the metal pipe 21 for connecting the lead wire 18, the terminal cap 22 and the lead wire 18 being secured to the heating rod 14 by silver soldering. Although the heating rod 14 is assembled while being held by the tip of the holder 15, since the heating rod 14 has a substantially elliptical cross-sectional configuration, it is necessary to make the opening at one end of the holder 15 to match with the heating rod 14 in order to positively secure the heating rod 14. However, to construct the holder 15 to have an elliptical opening is not only troublesome but also expensive. Accordingly, it is advantageous to prepare a metal pipe 21 having a substantially elliptical through opening 21*a* matching the configuration of the heating rod 14, independently of the holder 15, fitting the pipe 21 on the heating rod 14 and then fixing with silver soldering. The metal pipe 21 thus assembled is then fitted in the tip of the holder 15 and fixed thereto with silver soldering. This construction allows easy preparation of various component elements and reduces the manufacturing cost. Moreover, the heating rod 14 can be simply and positively secured to the holder 15 with sufficiently high mechanical strength. During operation, a diesel engine utilizing the glow plug 10 described above produces a substantial vibration, so that mounting of the heating rod 14 on the holder 15 presents a problem. But with the positively secured construction described above this problem does not occur.

The elliptical perforation 21*a* of the metal pipe 21 can be formed at a high accuracy by a simple drawing technique. It should, however, be understood that the perforation 21*a* may have a configuration other than an ellipse. One end of the resistor 11 contained in the heating rod 14, that is the end of the second lead conductor 11*c* is electrically connected to the holder 15 through the metal coating layer 19 and the metal pipe 21.

The other end of the resistor 11 exposed at the rear end of the heating rod 14, that is one end of the first lead conductor 11*b*, is connected to the outer external connecting terminal 17 mounted on the rear end of the holder 15 through the insulating bushing 16. In this case when the external connecting terminal 17 is secured directly to the rear end of the heating rod 14, there is a fear of disengaging the terminal 17 due to an external mechanical force applied thereto such as vibration or clamping torque so that it is necessary to resiliently interconnect these members. According to the preferred embodiment of the present invention the heating rod 14 and the external connecting terminal 17 are interconnected through a flexible conductor 18 such as a multistrand wire located in the longitudinal space chamber of the holder 15.

The terminal cap 22 is used to firmly secure the conductor 18 to the rear end of the heating rod 14 in the longitudinal space chamber of the holder 15. As shown in FIGS. 1 and 3, the terminal cap 22 is shaped to be fitted over the rear end the heating rod 14 and a mounting piece 22*a* adapted to secure the conductors 18 is provided for the bottom of the terminal cap 22. One end of the conductor 18 is secured to the mounting piece 22a by spot welding. The other end of the conductor 18 is also secured to the tip of the external connecting terminal 17 by spot welding.

The flexible conductor 18 may be substituted with a rigid electroconductor, in which case the conductor is resiliently connected to the mounting piece 22a of the terminal cap 22. The conductor 18 can also be resiliently connected to the external connecting terminal 17. Alternatively, at least one of the metal wire components may be bent to utilize its resiliency.

Figure 4:
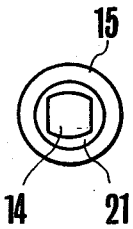
FIG. 4 is an end view of the assembled glow plug shown in FIG. 3.

The glow plug described above can readily be assembled in the following manner. A pair of ceramic bars 12 and 13 formed with a resistor 11 on the bonding surface are bonded together and then heat sintered to prepare a heating rod 14 having an excellent heat producing characteristic. Then a pipe 21 and a terminal cap 22 are fitted respectively over the central portion and the rear end of the heating rod 14 and secured by silver solder. Then one end of the conductor 18 is spot welded to the mounting piece 22a of the terminal cap 22 and the other end is spot welded to the tip of the external connecting terminal 17 fitted on the insulating bushing 16. These members are then inserted through the rear end of the holder 15 and the pipe 21 holding the heating rod 14 is secured to the tip of the holder 15 with silver solder, while the insulating bushing 16 on the periphery of the external connecting terminal 17 fitted on the rear end of the holder 15 is secured by caulking the rear end of the holder 15. The assembled state is shown in FIGS. 3 and 4.

The glow plug 10 thus assembled is threaded into the cylinder head of a diesel engine to cause the heating rod 14 mounted on the tip to project into a cylinder chamber. Voltage is applied across the external connection terminal 17 and the holder 15 to pass current through the resistor 11 in the heating rod thus heating the heater 11a. The heat thus generated is transmitted to a cover of ceramic materials and then radiated in the cylinder so as to increase its internal temperature thereby improving the starting characteristic of the engine.

It is to be particularly noted that the heating rod 14, embedding the resistor 11 therein, is made of ceramic material such as a silicon non-oxide material and that since the ceramic material has an excellent electrical insulating property and since the resistor is formed on the bonding surface and then embedded in the ceramic rod by sintering under pressure no surplus heating load is applied. Further, where tungsten is used as the resistor it is possible to red-heat it in a short time with a small current thus improving the temperature rise characteristic. The result of experiment shows that, with the glow plug according to this invention, it is possible to raise the temperature to 800° C. within 3 seconds. Especially, the heating portion 11a of the heater 11 is formed only at the tip which has the strongest influence upon the starting characteristic of the engine, and the heater portion 11a has a much smaller width than the pair of lead conductors 11b and 11c extending from the opposite ends of the heating portion 11a. Consequently, the heat generating characteristic is improved, thus improving the starting characteristic of the engine. Further, the heating rod 14 can be readily prepared by forming a resistor 11 on the bonding surface of one of the pair of ceramic rods 12 and 13, and then bonding together the pair of ceramic rods 12 and 13.

Although in the foregoing embodiment the heating rod 14 made up of a pair of ceramic rods 12 and 13 is constructed to have elliptical cross-sectional configuration and the heating rod 14 is inserted into the holder 15 by using a metal pipe 21 and a terminal cap 22 having cross-sectional configurations corresponding to that of the heating rod 14, it should be understood that the invention is not limited to such specific configurations. Where the environment permits, the heating rod may be connected directly on the tip of the holder and the lead conductor may be directly soldered without using a terminal cap.

The pattern of the resistor formed in the heating rod may be changed to vary its resistance value. It is essential to construct the tip of the heating rod that has a large influence upon the starting characteristic of an engine such that it will be rapidly red-heated.

Figure 5:
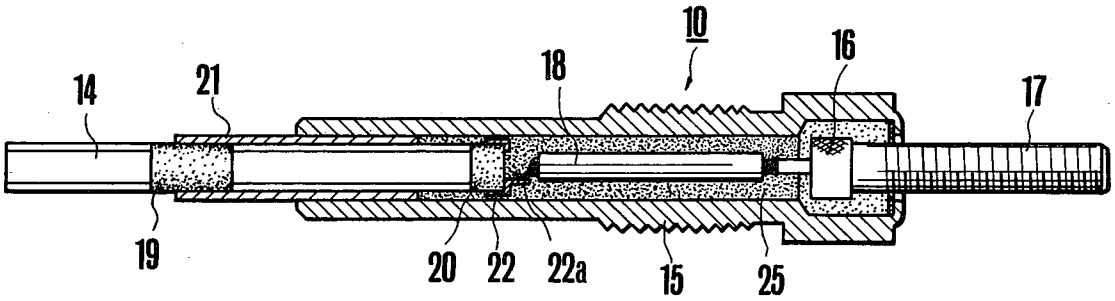
FIG. 5 is a longitudinal sectional view of a modified glow plug.

As shown in FIG. 5, a powder 25 of a heat resistant insulating material may be filled in a space in the holder 15 containing the heat conductor 18. More particularly, where the rear end of the heating rod 14 and the external connecting terminal 17 are interconnected by the conductor 18, it is necessary to prevent breakage of the connecting portions of the conductor 18 due to vibration caused by external mechanical force. This problem is serious especially when the conductor 18 is flexible. According to this modified embodiment, vibration of the conductor 18 is prevented by the insulating powder 25 packed in the holder 15. Cerammic powder such as magnesium oxide is suitable for the insulating powder 25. In the modification shown in FIG. 5, after insertion of various elements into the holder through its rear end, and prior to the mounting of the pipe 21 which holds the heating rod onto the tip of the holder 15, the insulating powder 25 is packed in the holder 15.

As described above, in the glow plug for use in a diesel engine according to the present invention, a pair of ceramic rods formed with a resistor on one bonding surface are bonded together to form a heating rod and then the heating rod is incorporated into a hollow holder so that the glow plug can be readily manufactured and has a sufficiently high mechanical strength.

Further, by changing the pattern of the resistor formed on one bonding surface, the resistance value can be readily varied so as to cause only a necessary portion to generate heat at a high speed thus improving the starting characteristic of a diesel engine.

Packing of an insulating powder about a conductor interconnecting the rear end of the heating rod and an external connection terminal as shown in FIG. 5 prevents breakage of the conductor caused by external force.

What is claimed is:

1. A glow plug for use in a diesel engine comprising a heating rod formed by bonding together a pair of ceramic rods having a resistor formed in a longitudinal direction of one bonding surface, a hollow electroconductive holder holding said heating rod at a front end, and an external connecting terminal connected to a rear end of said holder through an electrically insulating member, said resistor being constructed by a serially connected heating portion provided on a front portion of said ceramic rod, a lead portion extending from one end of said heating portion, a portion of said lead portion being exposed on the outer side of said heating rod and connected to said external connecting terminal, and another lead portion extending from the other end of said heating portion toward said rear end, a portion of said another lead portion being exposed to the outside of said heating rod and connected to said holder.

2. The glow plug according to claim 1 which further comprises a metal pipe fitted to said heater rod and electrically connected to the lead portion led out to the rear side of said heating rod so as to hold the same by the front end of said holder through said metal pipe.

3. The glow plug according to claim 1 or 2 which further comprise means embedded in said heating rod and resiliently interconnects a portion of said lead portion exposed at the rear end of said heating rod and said external connecting terminal.

4. The glow plug according to claim 3 wherein said resiliently interconnecting means comprises a multistrand conductor.

5. The glow plug according to claim 3 wherein said resiliently interconnecting means comprises a metal coating layer in contact with the lead portion exposed at the rear end and formed on a periphery of an end of said heating rod, a terminal cap secured to the metal coating layer of said heating rod, and a conductor with one end connected to said terminal cap, said conductor extending through a space in said holder, and the other end of said conductor being connected to said outer connecting terminal.

6. The glow plug according to claim 5 wherein the space in said holder is packed with a powder of heat resistant and electrically insulating material.

7. The glow plug according to claim 1 wherein said heating rod has a cross-sectional configuration other than a circle.

8. The glow plug according to claim 5 wherein said heating rod has an elliptical cross-sectional configuration.

9. The glow plug according to claim 2 wherein said heating rod has a cross-sectional configuration other than a circle and said pipe has an inner contour commensurate with the cross-sectional configuration of said heating rod.

10. The glow plug according to claim 8 wherein said heating rod has an elliptical cross-sectional configuration.

11. The glow plug according to claim 1 or 2 wherein said resistor formed on said bonding surface comprises a continuous strip including a heater portion and a pair of lead portions.

12. The glow plug according to claim 11 wherein the heater portion of said resistor has a width smaller than that of the pair of lead portions extending from both ends of said heater portion so as to increase resistance value.

13. A glow plug for use in a diesel engine comprising a heating rod formed by bonding together a pair of ceramic rod having a resistor on one bonding surface, a hollow holder holding said heating rod at a front end, an external connecting terminal mounted on a rear end of said holder through an insulating member, a conductor interconnecting a portion of said resistor on a rear end of said heating rod and said external connecting terminal, and a powder of heat resistant electrically insulating material packed in a space of said holder containing said conductor.

14. A glow plug for use in a diesel engine comprising a heating rod formed by bonding together a pair of ceramic rods provided with a resistor on one bonding surface, a hollow holder holding said heating rod at a fore end, and an external connecting terminal mounted on a rear end of said holder through an electrically insulating member, said heating rod having a cross-sectional configuration other than a circle, and is held at the front end of said holder through a metal pipe having a perforation corresponding to the cross-section configuration of said heating rod.

15. A glow plug for use in a diesel engine comprising a heating rod formed by bonding together a pair of ceramic rods provided with a resistor on one bonding surface, a hollow cylinder holding said heating rod at a fore end, and an external connecting terminal mounted on a rear end of said holder through an electrically insulating member, said resistor formed on said bonding surface including continuously formed heating portion provided on the front end of said ceramic rods, a lead portion extending rearwardly from one end of said heating portion, said lead portion being exposed from said heating rod and connected to said external connecting terminal, and another lead portion extending rearwardly from the other end of said heating portion, said another lead portion being exposed from said heating rod and connected to said holder, said heating portion having a width smaller than the widths of the pair of lead portions extending from both ends of said heating portion.

16. The glow plug according to claim 1 wherein said heating portion is provided on one end of said ceramic rod and is wavy in a direction perpendicular to an axis of said ceramic rod, said lead portions extend toward rearward from both ends of said heating portion, and the rear ends of said lead portions are exposed from said heating rod at opposed points spaced axially.

17. The glow plug according to claim 16 wherein one of the rear ends of said lead portions is exposed at the rear end of the ceramic rod and the other rear end of the lead portions is exposed to the outside of said heating rod through one side thereof at a point near the rear end.

18. The glow plug according to claim 1 or 2 which further comprises a coating layer coated on the outside of said heating rod which connects said portion of said another lead portion with said holder.

* * * * *

UNITED STATES PATENT AND TRADEMARK OFFICE

CERTIFICATE OF CORRECTION

PATENT NO. : 4,401,065

DATED : August 30, 1983

INVENTOR(S) : Sokichi Minegishi et al.

It is certified that error appears in the above-identified patent and that said Letters Patent is hereby corrected as shown below:

Column 2, line 5, delete "plug".

Column 3, line 3, after "lating" insert a comma -- , --.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*